United States Patent [19]

Robbins

[11] Patent Number: 5,004,025

[45] Date of Patent: Apr. 2, 1991

[54] METHOD AND APPARATUS FOR SLOWLY DISPENSING A SOLUTION FOR UNCLOGGING DRAINS

[76] Inventor: David L. Robbins, 504 Cleveland St., Rocky Mount, N.C. 27803

[21] Appl. No.: 413,207

[22] Filed: Sep. 27, 1989

[51] Int. Cl.[5] ..... B08B 3/08

[52] U.S. Cl. ..... 141/364; 4/256; 4/DIG. 10; 15/104.050; 222/482

[58] Field of Search ..... 4/255-257, 4/DIG. 10, 225, 226, 228; 141/363-366, 392; 222/481, 482, 565; 15/104.05; 220/66

[56] References Cited

U.S. PATENT DOCUMENTS

| | | | |
|---|---|---|---|
| 977,005 | 11/1910 | Haddock | 4/256 |
| 1,693,956 | 12/1928 | Moore | 220/66 |
| 1,821,789 | 9/1931 | Borgeson | 15/104.05 X |
| 2,000,167 | 5/1935 | Forman | 222/482 |
| 2,016,512 | 10/1935 | Pinney et al. | 220/66 X |
| 2,430,976 | 11/1947 | Dutra | 4/256 |
| 2,726,406 | 12/1955 | Vierra | 4/228 |
| 2,822,962 | 2/1958 | Poitras | 222/481 |
| 3,864,763 | 2/1975 | Spransy | 4/228 X |
| 4,116,850 | 9/1978 | Ruck | 252/103 |
| 4,387,750 | 6/1983 | McNerney | 141/363 X |

FOREIGN PATENT DOCUMENTS

| | | | |
|---|---|---|---|
| 0682649 | 12/1952 | Netherlands | 4/228 |

*Primary Examiner*—Renee S. Luebke
*Assistant Examiner*—Casey Jacyna
*Attorney, Agent, or Firm*—Rhodes, Coates & Bennett

[57] ABSTRACT

An anti-drain clogging device used to containerize and dispense anti-clogging solution into a drain pipe in a controlled slow flow manner over an extended period of time. The anti-drain clogging device has a main container section for holding anti-drain clogging solution and a dispensing section for directing the anti-drain clogging solution from the container section to the inlet of a drain pipe. The device has both a liquid-tight, stable storage mode that the device is placed in prior to use and an operational mode where the device is adjustably fixed over a drain pipe inlet. In the operational mode, the dispensing section is adjusted to a chosen position over the opening of the drain pipe inlet by adjusting a support collar attached to the device. In this position, anti-clogging drain solution drips from the dispensing section in a controlled, slow manner into the drain pipe to steadily dissolve, layer by layer, the clogging and sediment in the pipe over a period of time.

5 Claims, 2 Drawing Sheets

METHOD AND APPARATUS FOR SLOWLY DISPENSING A SOLUTION FOR UNCLOGGING DRAINS

FIELD OF THE INVENTION

This invention relates to drain clogging prevention and more particularly to devices and methods for containerizing and dispensing anti-clogging liquids into a drain pipe.

BACKGROUND OF THE INVENTION

Clogging of drain pipes is a common problem in both residential homes and commercial businesses. During normal use of drain pipes, liquid flowing through the drain pipes contains solid material or sediment which tends to adhere to the pipes inner surface. If the solid material adhering to the pipe is not periodically removed, the adhering solid material builds-up until the liquid flow rate through the pipe is substantially decreased and back-up of the drain pipe occurs.

In the past, liquid dissolvents were poured down drain pipes in order to dissolve clogging sediment build-up in drain pipes. However, in order for the liquid dissolvent to work most effectively on the sediment build-up on the pipe surfaces, the liquid dissolvent must remain in contact with the sedimennt for a sufficient amount of time to allow the liquid dissolvent to react with and dissolve the clogs. The problem with the past solution to preventing drain pipe clogging is that when the liquid dissolvent was poured into the drain pipe it quickly flowed through the pipe and over the outer surface of the sediment without allowing the dissolvent a sufficient amount of time to remain in contact with the sediment. Instead, due to the speed of the liquid dissolvent flowing by the sediment or clog, only an outer layer of the sediment was removed and substantial sediment remained within the drain pipe unaffected by the liquid dissolvent. Because the clogging often was not removed with one application of the liquid dissolvent, the dissolvent had to be repeatedly poured down the sink on several different occasions by the user of the liquid dissolvent. Having to repeatedly pour liquid dissolvent down a drain pipe was both time consuming and annoying to the user. In addition, a large portion of the liquid dissolvent was wasted when it flowed past the clog without reacting with the clog. Even when the repeated pouring of liquid dissolvent down the drain pipe does increase the flow rate through the drain pipe to an acceptable flow rate, sediment unaffected by the flow dissolvent poured into the drain pipe often remains attached to the drain pipes causing more rapid build-up of clogs within the drain pipe.

SUMMARY AND OBJECTS OF THE INVENTION

The present invention, drain clogging prevention device, provides a more effective device and method for preventing and removing sediment build-up or clogging within a drain pipe. This is accomplished by continuously dispensing a small controlled amount of liquid dissolvent into a drain pipe over a relatively extended period of time. By continuously passing the liquid dissolvent over the clogs and sediment within the drain pipes, the sediment is dissolved layer by layer to remove a more substantialy amount of the sediment adhering to and clogging the drain pipe.

In the preferred embodiment, the drain clogging prevention device for holding and controllably dispensing liquid dissolvent includes a cylindrical container with a bottom section having a bottom container opening and a top section having a top container opening. Fitted over the top container opening and attached to the container's top section is a cylindrical dispensing member. The dispensing member has a first opening at one end of the tube which is adjacent to the container's bottom opening and a second opening at the opposite end to the tube.

In the non-operational mode, the drain clogging prevention device provides a liquid-tight container used to hold liquid dissolvent until the dispensing of the liquid dissolvent and cleaning of the drain pipes is undertaken. In this mode, the dispensing member's outer opening is fitted with a removable cap and the opening in the bottom section of the container is fitted with a removable plug. The drain clogging prevention device then provides a liquid-tight container that can then be placed in a stored position by resting the container's bottom section on a flat surface.

At regular intervals or when drain clogging has occured, the stored liquid dispensing container can easily be placed into an operational mode and used to dispense liquid dissolvent into the drain pipe. The first step to prepare the dispensing container for operation is to place the container's bottom section on a flat surface and then remove the end fitted over dispensing member's the outer opening. An extension is then attached to the dispensing member over the outer opening. With the extension attached, the container is inverted and an adjustable support collar fitted to the tube is fitted over the structure surrounding the inlet to the drain pipe such that the dispensing member with the attached extension downwards towards the pipe inlet. The extension has small openings that dispenses the liquid dissolvent in a slow drop-like manner while the container is in the inverted position.

The container is then left in this inverted position for a sufficient period of time to cause the clogging sediment to be dissolved from the drain pipe. Hot water is then put into the drain pipe to wash any remaining sediment loosened by the dissolvent out of the drain pipe.

In view of the above, it is an object of the present invention to provide an effective and easy method and device for removing clogs and sediment within a drain pipe.

Another object of the present invention is to provide a device which dispenses an anti-drain clogging solution in a slow manner into a drain pipe in order to allow the solution to dissolve and remove drain clogs piece by piece.

Another object of the present invention is to provide a method for preventing drain clogging that provides a method for dispensing an anti-drain clogging solution in a slow, controlled manner over an extended period of time such that the clogs and sediment within a drain pipe remain in contact with the dissolving solution for a longer period of time.

Another object of the present invention is to provide a device which can be placed in a liquid-tight and stable stored position.

Another object of the present invention is to provide an anti-drain clogging device which regulates the flow rate of anti-drain clogging solution dispensed from the device.

Another object of the present invention is to provide an anti-drain clogging device for dispensing solution that can be adjustably fixed at the inlet of a drain pipe.

Other objects and advantages of the present invention will become apparent and obvious from a study of the following description and the accompanying drawings which are merely illustrative of such invention.

DETAILED DESCRIPTION OF THE INVENTION

Figure 1:
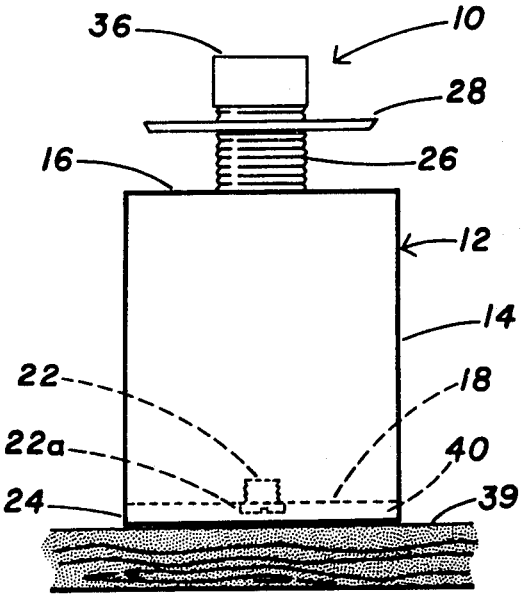
FIG. 1 is a side elevational view of the slow dispensing anti-clogging solution container of the present invention with the same shown in an upright storage position.

Referring to the drawings, the anti-drain clogging solution container and dispenser is shown therein and indicated by the numeral 10.

Dispenser 10 includes a cylindrical container section 12 with a side wall structure 14 and a container section top 16 and bottom 18 at opposite ends of the side wall structure 14. Container section 12 holds anti-drain clogging solution which is dispensed into a drain pipe by the dispenser 10 in order to remove clogging within a drain pipe. A pressure opening 20 is formed in the bottom 18 of the container section 12 and a screw plug 22 screws into the pressure opening 20 to provide a liquid tight attachable and detachable plug means for opening 20. Container section bottom 18 also has a support ridge 24 surrounding and protruding from the outer circumference of the bottom 18 which is used as a platform to support the dispenser 10 when the dispenser 10 is in a non-operational stored position, as shown in FIG. 1.

Container top 16 has a top opening leading to a dispensing neck 26 integrally connected to the container top 16. Dispensing neck 26 provides a convenient cylindrical spout for directing anti-drain clogging solution held within the container section 12 into the inlet of a drain pipe. Dispensing neck 26 has adjustment screw threads 30 on its outer surface which provides an adjustable means about the vertical axis of the dispensing neck 26 for a support collar 28 fitted around the dispensing neck 26. Support collar 28 is a disk-shaped member with an inner opening 32 through which the dispensing neck 26 is inserted. The support collar 28 is axially adjusted on the dispensing neck 26 by rotating the support collar 28 such that screw ridges in the support collar's opening 32 move along the dispensing neck's screw ridges 30.

As shown in FIG. 1, dispenser 10 has a convenient non-dispensing or storage mode that permits the dispenser 10 to be put in a liquid-tight state and placed in a stable position prior to the use of the dispenser 10. When the dispenser 10 is in the stored position, the screw plug 22 is tightly screwed into the dispenser's bottom pressure opening 20 to provide a liquid-tight seal at the opening 20 to prevent the anti-drain clogging solution from spilling. In addition, a dispensing neck cap 36 screws onto the end of the neck 36 to provide a liquid-tight seal at neck opening 38.

To place dispenser 10 in a stable storage position, the support ridge 24 surrounding the container section's bottom 18 is placed against a flat support surface 39 such that the dispenser 10 stands in a stable upright position as shown in FIG. 1. Ridge 24 gives additional stability to the dispenser 10 in this position and also provides a recess space 40 for the screw plug head **22*a*. Positioning screw plug head 22*a* in this recess area 40 allows the dispenser to be placed in an upright stored position without screw plug 22 interfering with the support ridge's contact with the underlying support surface 39. In the preferred embodiment, the height of dispenser 10 in this upright stored position is approximately six inches so that the dispenser 10** can conveniently be placed under most bathroom sinks.

Figure 2:
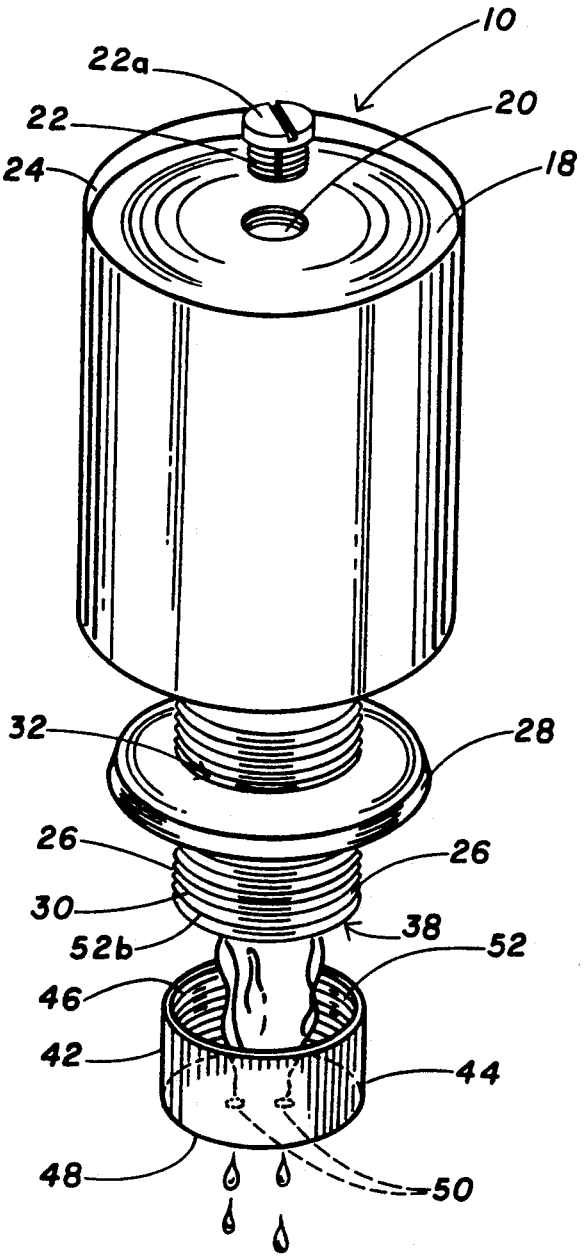
FIG. 2 is a perspective view of the container of the present invention showing the dispensing cap being removed from the neck of the container.
Figure 3:
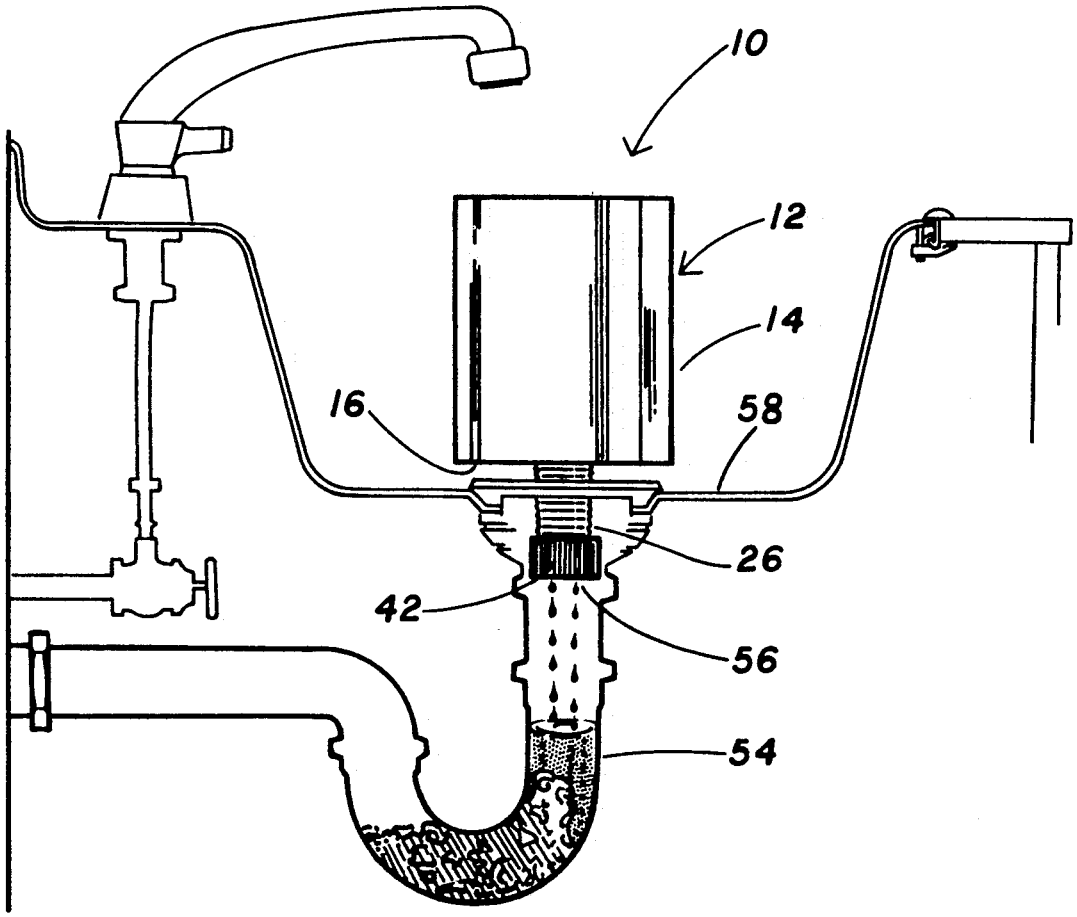
FIG. 3 is a side elevational view illustrating the drain anti-clog solution dispenser being disposed in an inverted position.

As shown in FIG. 2 and 3, dispenser 10 is easily placed from the stored position into an adjustable operational position for controllably dispensing anti-drain clogging solution. While in the upright stored position, the dispenser neck cap 36 is unscrewed from dispenser neck 26. A separate extension member 42 is then attached to the neck 26 over the unblocked neck opening 38. Extension member 42 has a cylindrical wall structure 44 with an open top 46 at one end of the wall structure 44 and a closed bottom 48 with two small dispensing holes 50 at the other end of the wall structure 44. The side wall structure 44 has extension screw grooves **52*a* on its inner surface adjacent the top opening 46 which match with adjustment or extension screw threads 30*b* on the end of the neck 26. To attach the extension member 42 to the dispensing neck 26, the open top 46 of the extension 42 is fitted over the neck opening 38 by screwing extension screw grooves 52*a* onto dispensing neck 26**.

Once the extension is firmly attached to the neck 26, the dispenser's position can be inverted and placed over the inlet of a drain pipe structure. As shown by FIG. 3, the support collar 28 fitted about the dispenser neck 26 is rested on the top of the drain structure 50 and supports the dispenser 10 in an inverted position with the dispenser neck 26 and extension 42 directed above the drain inlet 56. The bottom 48 of the extension 42 should be placed close to the inlet 56 to prevent dripping of the anti-drain clogging solution onto the surrounding drain structure 58. Support collar 28 is adapted to be adjusted along the axis of the dispenser neck 26 so that the end of extension 42 can be lowered or raised from the drain inlet 56. For instance, to position the extension member 42 closer to the drain inlet 56, support collar 28 is screwed upwards on dispensing neck 26 towards the container section 12. Conversely, for a drain structure with a surrounding wall structure 58 of lesser height the support collar 28 is screwed downwards on the dispenisng neck 26 to decrease the portion of the dispensing neck 26 extending below the support collar 28 in order to properly position the extension member 42 over the drain inlet 56. In this way, the dispenser 10 can be adjusted to effectively fit different sized drain structures.

Once the dispenser 10 is properly fitted over the drain structure and the extension member 42 is properly positioned over the drain inlet 56, screw plug 22 is removed with an ordinary screw driver to allow atmospheric pressure into dispenser 10 through the container section's pressure opening 20. This atmospheric pressure helps force the anti-drain clogging solution out of the extension members dispensing holes 50.

After removal of the screw plug 22, the dispenser 10 is in its operational mode and begins to slowly dispense the anti-drain clogging solution. The dispenser 10 can then be left in position by the user over-night or for a period of time till the clog is dissolved from the drain pipe 54. In the preferred embodiment, the size of the dispensing holes causes the dispenser solution to have a flow rate of fifteen to twenty minutes per thirty-two to thirty-six fluid ounces. As shown in FIG. 3, the anti-drain clogging solution drips from the extension member 42 through the drain inlet 56 and into the drain pipe 54. As the solution flows through the drain pipe 54 it dissolves successive layers of any clogs or sediment within the drain pipe until most or all of the clogs is dissolved or loosened from the inner surfaces of the drain pipe 54. The dispenser 10 can then be removed from the drain structure and either disposed of or refilled with anti-drain clogging solution and placed in a stored position. Then hot water is flashed down the drain pipe 54 to remove any remaining clogs that were loosened by the dissolving solution.

Extension members of varying lengths and sizes may be used to adapt the anti-drain clogging device to different drain pipes and their surrounding structures. For instance, a lengthened extension member can be used if it is desired to extent the extension member within a drain pipe. Additionally, depending on the circumstances, the dispensing opening on particular extension members may be of various sizes and numbers in order to alter the flow rate and flow pattern of the anti-drain clogging solution dispensed from the device.

From the foregoing, it is apparent that is desirable to dispense the anti-clogging solution at a relatively slow rate. The rate of flow from the container would preferably be in the range of 15 to 20 minutes of flow per 32–36 ounces of fluid. This essentially means that there would be a continuous steady stream of anti-clogging solution being admitted from the container into the drain. The stream would be relatively thin stream that in one typical application the stream would be about the size of the pencil lead.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. an anti-clogging solution container and drop dispenser device for containerizing and slowly dispensing a drain unclogging solution into an inlet of a clogged drain comprising:

(a) a container having a main body portion including a surrounding side wall structure and a bottom;

(b) the bottom being indented such that the side wall structure extends downwardly there past so as to define an open space between the bottom and the underlying support surface when the container is sitting in an upright position on the support surface;

(c) an openable and closeable vent formed in the bottom of the container;

(d) a top forming a part of the container and a dispensing neck integral with the top and extending therefrom, the neck having a remote end and having threads that extend substantially the entire distance from the remote end of the neck to the top of the container;

(e) a first top enclosure secured to the open end portion of the dsipensing neck for totally closing the container so as to maintain the container closed prior to dispensing;

(f) a dispenser attachable to the open end of the neck and adapted to effectively replace the first top enclosure for dispensing drain anti-clogging solution from the container such that wherein the drain anti-clogging solution may be slowly dispensed; and (g) an adjustable support collar threaded on the neck between the top and the dispenser and movable back and forth thereon between the top and the dispenser for supporting the container above the drain inlet, the collar having a circumferential bearing surface for engaging and resting upon the drain inlet and wherein the position of the container and dispenser can be adjusted by rotating the support collar about the neck such that the container and dispenser can both be moved up and down with respect to the drain inlet.

2. An anti-clogging solution container and drop dispenser device containerizing dispensing anti-drain clogging solution into an inlet of a clogged drain comprising:

(a) a container having a main body portion with a side wall structure, a top, and a bottom;

(b) a dispenser section connected to the top of the main body portion, wherein the dispenser section provides a means for dispensing an anti-drain clogging solution into a drain pipe inlet in a relative slow manner over an extended period of time whereby the clogs and sediment within the drain are exposed to and are slowly dissolved by the solution;

(c) the dispensing section including a neck extending from the top and a drain dispenser secured to the neck. the neck having a remote end and having threads that extend substantially the entire distance from the remote end of the neck to the top of the container; and (d) an adjustable support collar threaded on the neck between the top and the dispenser and movable back and forth thereon between the top and the dispenser for supporting the container above the drain inlet, the collar having a circumferential bearing surface for engaging and resting upon the drain inlet and wherein the position of the container and dispenser can be adjusted by rotating the supprt collar about the neck such that the container and dispenser can both be moved up and down with respect to the drain inlet.

3. The anti-drain clogging solution device of claim 2 wherein the dispenser section includes a removable dispenser extension which regulates the flow of anti-drain clogging solution from the device.

4. The anti-drain clogging solution container and drop dispense of claim 2 wherein the container's top portion has an opening having means for covering and uncovering the opening such that the opening can be covered to prevent solution from escaping from the openig when the container is in a stored position and such that the opening can be be uncovered to allow atmospheric pressure into the container to help control the dispensing of solution from the dispenser into the inlet pipe.

5. The anti-drain clogging solution container and drop dispenser of claim 2 wherein the container bottom has a ridge extending from the container's bottom surface such that the ridge provides a platform on which the container rest when the container is in a stored position.

* * * * *